US009207597B2

(12) United States Patent
Matsusaka et al.

(10) Patent No.: US 9,207,597 B2
(45) Date of Patent: Dec. 8, 2015

(54) FIXING DEVICE AND IMAGE FORMING APPARATUS INCORPORATING SAME

(71) Applicants: Susumu Matsusaka, Kanagawa (JP); Motokazu Hasegawa, Kanagawa (JP); Yukari Isoe, Kanagawa (JP)

(72) Inventors: Susumu Matsusaka, Kanagawa (JP); Motokazu Hasegawa, Kanagawa (JP); Yukari Isoe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/156,628

(22) Filed: Jan. 16, 2014

(65) Prior Publication Data

US 2014/0219694 A1 Aug. 7, 2014

(30) Foreign Application Priority Data

Feb. 5, 2013 (JP) ..... 2013-020279

(51) Int. Cl.
*G03G 15/20* (2006.01)

(52) U.S. Cl.
CPC .... *G03G 15/2053* (2013.01); *G03G 2215/2032* (2013.01)

(58) Field of Classification Search
CPC ..... G03G 15/2053
USPC ..... 399/329
See application file for complete search history.

(56) References Cited

U.S. PATENT DOCUMENTS

| | | | | |
|---|---|---|---|---|
| 2006/0285893 | A1 | 12/2006 | Ishii | |
| 2007/0274748 | A1 | 11/2007 | Yoshikawa | |
| 2008/0149621 | A1 * | 6/2008 | Kanou et al. | 219/619 |
| 2011/0293338 | A1 * | 12/2011 | Ko et al. | 399/329 |
| 2012/0177418 | A1 | 7/2012 | Hashiyada et al. | |
| 2013/0142551 | A1 * | 6/2013 | Yamano et al. | 399/328 |

FOREIGN PATENT DOCUMENTS

| | | | |
|---|---|---|---|
| JP | 2000181258 | A * | 6/2000 |
| JP | 2002072722 | A * | 3/2002 |
| JP | 2006-350054 | | 12/2006 |
| JP | 2007-264021 | | 10/2007 |
| JP | 2007-316540 | | 12/2007 |
| JP | 2009-014896 | | 1/2009 |
| JP | 2009-014972 | | 1/2009 |
| JP | 2009-259588 | | 11/2009 |
| JP | 2012-063791 | | 3/2012 |
| JP | 2012-159829 | | 8/2012 |

* cited by examiner

*Primary Examiner* — Clayton E Laballe
*Assistant Examiner* — Leon W Rhodes, Jr.
(74) *Attorney, Agent, or Firm* — Oblon, McClelland, Maier & Neustadt, L.L.P.

(57) ABSTRACT

A fixing device includes a rotator having a heat generation layer, an excitation coil to inductively heat the heat generation layer, ferromagnetic cores to direct magnetic flux arising from the excitation coil to the rotator, and a holder to hold the excitation coil and the ferromagnetic cores. In the fixing device, the ferromagnetic cores include multiple cores disposed astride the excitation coil at a turning part on each end of the excitation coil in a longitudinal direction of the excitation coil.

7 Claims, 9 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2013-020279, filed on Feb. 5, 2013, in the Japan Patent Office, the entire disclosure of which is hereby incorporated by reference herein.

BACKGROUND

1. Technical Field

Embodiments of this disclosure generally relate to a fixing device to fix an unfixed toner image, and to an image forming apparatus, such as a copier, a printer, a facsimile machine, or a multifunction machine having two or more of copying, printing, and facsimile functions, employing an electrophotographic system and incorporating the fixing device.

2. Related Art

Image forming apparatuses, such as copiers, printers, facsimile machines, or multifunction machines having two or more of copying, printing, and facsimile functions usually incorporate a fixing device employing an electromagnetic induction heating method to reduce startup time of the image forming apparatuses incorporating the fixing device, thereby saving energy. For example, JP-2006-350054-A discloses such a fixing device using the electromagnetic induction heating method. The fixing device includes, e.g., a support roller (or a heating roller) serving as a heat generator, an auxiliary fixing roller (or a fixing roller), a fixing belt stretched over the support roller and the auxiliary fixing roller, an induction heater, serving as an induction heating unit, facing the support roller via the fixing belt, and a pressing roller to contact the auxiliary fixing roller via the fixing belt. The induction heater includes, e.g., a coil (or an excitation coil) wound in a longitudinal direction of the induction heater, and cores (or excitation coil cores) facing the coil. The induction heater faces and heats the fixing belt. The heated fixing belt heats and fixes a toner image on a recording medium conveyed at a fixing nip formed between the auxiliary fixing roller and the pressing roller.

Specifically, when a high-frequency alternating current is supplied to the coil, an alternating magnetic field formed around the coil generates eddy currents on a surface of the support roller and its neighboring area. When the eddy currents are generated around the support roller, the electric resistance of the support roller leads to Joule heating of the support roller, thereby heating the fixing belt stretched over the support roller.

In such a fixing device employing the electromagnetic induction heating method, a heat generator is directly heated by electromagnetic induction. Accordingly, compared to a fixing device using a halogen heater, such a fixing device employing the electromagnetic induction heating method has a higher heat-exchange efficiency and therefore the surface temperature of the fixing belt can be increased to a desired fixing temperature with reduced energy and a shorter startup time.

However, the electromagnetic induction heating method has difficulty in uniformly heating a heat generator in a longitudinal direction thereof because of the following two reasons. One reason is the behavior of eddy currents in the heat generator, and more specifically, for example, variation of the behavior of eddy currents caused by the shape of coil. In the process of the electromagnetic induction heating, eddy currents are generated in the heat generator by magnetic flux arising from the coil serving as a magnetic flux generator, and releases heat (i.e., Joule heating). Thus, the heat generator generates heat. The eddy currents basically follow the shape of a coil disposed in an induction heater.

Specifically, if the coil disposed facing the heat generator has only a straight part, the eddy currents travel in a linear manner. Accordingly, the heat generator is heated in a substantially uniform manner. However, in practice, the coil is turned somewhere. Typically, end portions of the heat generator correspond to turning parts of the coil, and the eddy currents traveling in the end portions of the heat generator differ from the eddy currents traveling in a middle portion of the heat generator. Accordingly, the heat distribution of the heat generator is not uniform in the longitudinal direction thereof.

The other reason is the shape of coil.

The induction heater heats the heat generator by the magnetic flux arising from the coil serving as a magnetic flux generator. Accordingly, if the magnetic flux arising from the coil is uniform in the longitudinal direction of the heat generator, the heat generator can be heated in a substantially uniform manner. However, as described above, the coil is turned somewhere in practice. The magnetic flux interlinking the heat generator is different at the end portions of the heat generator corresponding to the turning parts of the coil and at the middle portion of the heat generator. Accordingly, the heat distribution of the heat generator is not uniform in the longitudinal direction thereof.

Because of the above-described two reasons, a typical fixing device employing the electromagnetic induction heating method has a problem such that a heat generator used therein does not uniformly generate heat in a longitudinal direction thereof.

JP-2009-014972-A provides, e.g., an end core that covers an end of an excitation coil in a longitudinal direction thereof, thereby enhancing efficiency of heat generation by a heat generator. However, the shape of such an end core is relatively complicated, and moreover the end core is connected to another core.

SUMMARY

This specification describes below an improved fixing device. In one embodiment of this disclosure, the fixing device includes a rotator having a heat generation layer, an excitation coil to inductively heat the heat generation layer, ferromagnetic cores to direct magnetic flux arising from the excitation coil to the rotator, and a holder to hold the excitation coil and the ferromagnetic cores. In the fixing device, the ferromagnetic cores include multiple cores disposed astride the excitation coil at a turning part on each end of the excitation coil in a longitudinal direction of the excitation coil.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
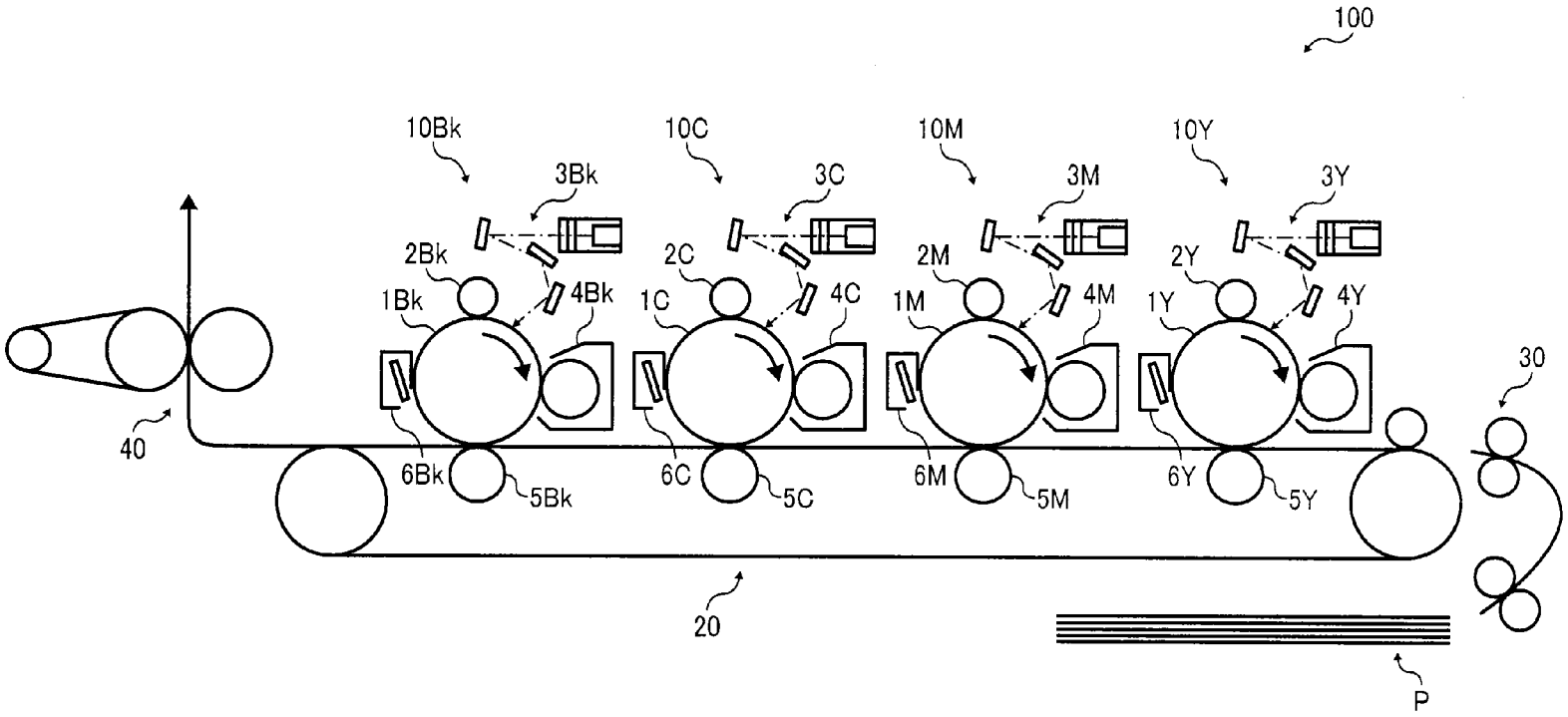
FIG. 1 is a schematic view of an image forming apparatus according to some embodiments of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals will be given to identical or corresponding constituent elements such as parts and materials having the same functions, and redundant descriptions thereof will be omitted unless otherwise required.

Referring now to the drawings, wherein like reference numerals designate identical or corresponding parts throughout the several views, embodiments of the present disclosure are described below.

Initially with reference to FIG. 1, a description is given of a configuration and operation of an image forming apparatus 100 according to some embodiments of this disclosure.

FIG. 1 is a schematic view of the image forming apparatus 100 according to some embodiments of this disclosure. It is to be noted that, in the following description, suffixes Y, M, C, and Bk denote colors yellow, magenta, cyan, and black, respectively.

The image forming apparatus 100, herein serving as a printer, includes four imaging stations 10Y, 10M, 10C, and 10Bk serving as imaging units and employing an electrophotographic method. The imaging stations 10Y, 10M, 10C, and 10Bk include photoconductive drums 1Y, 1M, 1C, and 1Bk serving as image carriers, respectively, and form toner images of yellow, magenta, cyan, and black on surfaces of the photoconductive drums 1Y, 1M, 1C, and 1Bk, respectively.

A conveyance belt 20 is disposed below the imaging stations 10Y, 10M, 10C and 10Bk to convey a recording material such as a sheet P through the imaging stations 10Y, 10M, 10C and 10Bk.

The photoconductive drums 1Y, 1M, 1C, and 1Bk of the respective imaging stations 10Y, 10M, 10C and 10Bk are disposed to contact the conveyance belt 20 while rotating. The sheet P electrostatically adheres to a surface of the conveyance belt 20.

It is to be noted that the four imaging stations 10Y, 10M, 10C, and 10Bk have similar configurations, differing only in the color of toner employed. Hence, a description is herein given only of the imaging station 10Y employing the yellow color, which is disposed at a most upstream end in a direction in which the sheet P is conveyed, as a representative example of the imaging stations 10Y, 10M, 10C and 10Bk. Descriptions of the imaging stations 10M, 10C and 10Bk are herein omitted, unless otherwise required.

The imaging station 10Y includes the photoconductive drum 1Y disposed substantially at a center of the imaging station 10Y. The photoconductive drum 1Y contacts the conveyance belt 20 while rotating. The photoconductive drum 1Y is surrounded by various pieces of imaging equipment, such as a charging device 2Y, an exposure device 3Y, a developing device 4Y, a transfer roller 5Y, a drum cleaner 6Y, and a charge neutralizing device, disposed sequentially along a direction of rotation of the photoconductive drum 1Y. The charging device 2Y charges the surface of the photoconductive drum 1Y so that a predetermined electric potential is created on the surface of the photoconductive drum 1Y. The exposure device 3Y directs light to the charged surface of the photoconductive drum 1Y according to an image signal after color separation to form an electrostatic latent image on the surface of the photoconductive drum 1Y. The developing device 4Y develops the electrostatic latent image thus formed on the surface of the photoconductive drum 1Y with toner of yellow, thereby forming a visible image, also known as a toner image of yellow. The transfer roller 5Y serving as a transfer device transfers the toner image thus developed onto the sheet P conveyed by the conveyance belt 20. The drum cleaner 6Y removes residual toner remaining on the surface of the photoconductive drum 1Y after a transfer process. The charge neutralizing device removes residual charge from the surface of the photoconductive drum 1Y.

A sheet supplying unit 30 is disposed to the right of the conveyance belt 20, at a bottom right in FIG. 1, to supply the sheet P onto the conveyance belt 20.

Additionally, a fixing device 40 according to some embodiments of this disclosure is disposed to the left of the conveyance belt 20 in FIG. 1. The sheet P conveyed by the conveyance belt 20 is then continuously conveyed to the fixing device 40 through a conveyance path, which extends from the conveyance belt 20 through the fixing device 40.

The fixing device 40 applies heat and pressure to the sheet P thus conveyed, on a surface of which the toner images of yellow, magenta, cyan, and black are transferred. Thus, the fixing device 40 fuses the toner images of yellow, magenta, cyan, and black transferred on the sheet P so that the toner images of yellow, magenta, cyan, and black permeate the sheet P, thereby fixing the toner images of yellow, magenta, cyan, and black onto the sheet P. The sheet P is then discharged by a pair of discharging rollers disposed on a downstream side of the conveyance path passing through the fixing device 40.

Figure 2:
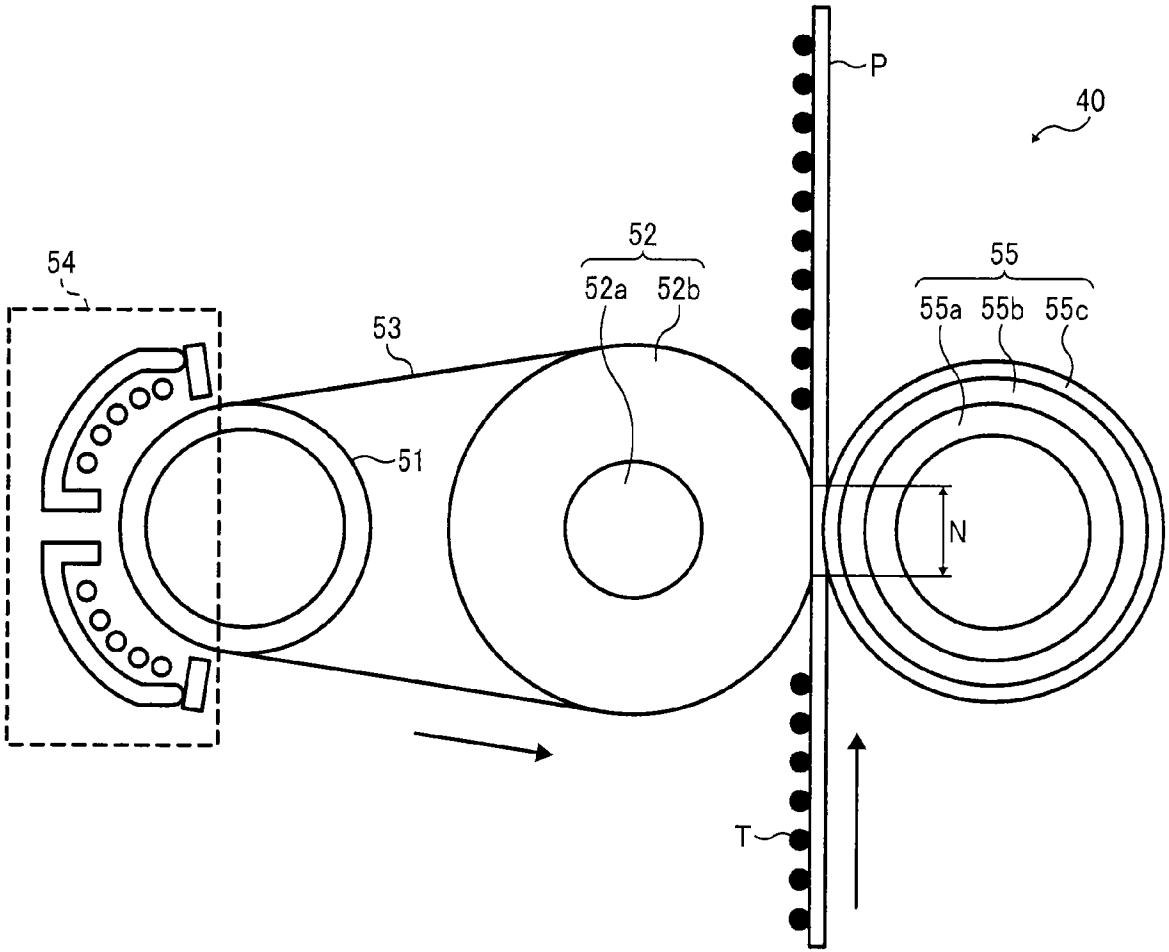
FIG. 2 is a schematic view of a fixing device according to a first embodiment incorporated in the image forming apparatus of FIG. 1.

Referring now to FIG. 2, a description is given of a fixing device 40 according to a first embodiment.

FIG. 2 is a schematic view of the fixing device 40 according to the first embodiment.

The fixing device 40 is configured as a belt fixing device. The fixing device 40 includes, e.g., a heating roller (or a support roller) 51 serving as a heat generator and a rotator, a fixing roller 52, a fixing belt 53 stretched over the heating roller 51 and the fixing roller 52, an induction heater 54 facing the heating roller 51 via the fixing belt 53, and a pressing roller 55 configured to contact the fixing roller 52 via the fixing belt 53.

The heating roller 51 includes nonmagnetic stainless steel and has a metal core with a thickness of from about 0.2 mm to about 1 mm. A surface of the metal core of the heating roller 51 is covered by a heat generation layer. The heat generation layer includes copper (Cu) and has a thickness of from about 3 gm to about 20 gm to enhance the efficiency of heat generation. Preferably, the surface of the heat generation layer is nickel-plated to prevent rust. A ferrite core may be disposed inside the heating roller 51 to enhance the efficiency of heat generation.

Instead of the stainless steel, the heating roller 51 may include a magnetic shunt alloy having a Curie point of from about 160° C. to about 220° C. An aluminum member is disposed inside the magnetic shunt alloy to stop a temperature rise around the Curie point. The heating roller 51 including the magnetic shunt alloy can also enhance the efficiency of heat generation by covering the surface of the heating roller 51 with a nickel-plated heat generation layer including copper (Cu).

The fixing roller 52 includes a metal core 52*a* and an elastic member 52*b*. The metal core 52*a* includes, e.g., stainless steel or carbon steel. The elastic member 52*b* includes, e.g., solid or foam heat-resistant silicone rubber to cover the meal core 52*a*. The pressing roller 55 contacts the fixing roller 52 while applying pressure to the fixing roller 52, thereby forming a fixing nip N in a predetermined width between the pressing roller 55 and the fixing roller 52. The fixing roller 52 has an outer diameter of from about 30 mm to about 40 mm. The elastic member 52*b* has a thickness of from about 3 mm to about 10 mm and a JIS-A hardness of from about 10° to about 50°.

Figure 3:
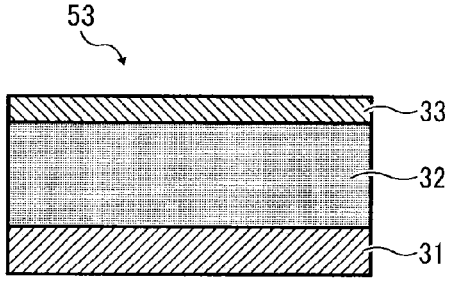
FIG. 3 is a cross-sectional view of a fixing belt incorporated in the fixing device of FIG. 2.

Referring now to FIG. 3, a description is given of an example of the fixing belt 53 in detail.

FIG. 3 is a cross-sectional view of the fixing belt 53 according to the first embodiment.

The fixing belt 53 includes a substrate 31, an elastic layer 32, and a release layer 33. As illustrated in FIG. 3, the elastic layer 32 is stacked on the substrate 31, and the release layer 33 is stacked on the elastic layer 32.

The substrate 31 has characteristics such as mechanical strength and flexibility when the fixing belt 53 is stretched, and resistance against heat at a fixing temperature. According to the first embodiment, the induction heater 54 heats the heating roller 51 by electromagnetic induction heating. Hence, the substrate 31 preferably includes an insulating heat-resistant resin material such as polyimide, polyimide-amide, polyether-ether ketone (PEEK), polyether sulfide (PES), polyphenylene sulfide (PPS), or fluorine resin. The substrate 31 preferably has a thickness of from about 30 μm to about 200 μm for heat capacity and strength.

The elastic layer 32 is employed to give flexibility to a surface of the fixing belt 53 to obtain a uniform image without uneven glossiness. Hence, the elastic layer 32 preferably includes an elastomer material having a JIS-A hardness of from about 5° to about 50° and has a thickness of about 50 μm to about 500 μm. For resistance against heat at a fixing temperature, the elastic layer 32 includes e.g., silicone rubber or fluorosilicone rubber.

The release layer 33 includes a material of, e.g., fluorine resin such as tetrafluoride ethylene resin (PTFE), tetrafluoride ethylene-perfluoroalkyl vinylether copolymer resin (PFA) and tetrafluoride ethylene-hexafluoride propylene copolymer (FEP), combinations of the foregoing resin materials, or heat-resistant resin in which the above-described fluorine resin is dispersed.

By coating the elastic layer 32 with the release layer 33, releasing performance of toner can be enhanced without using silicone oil, thereby preventing paper dust from sticking to the fixing belt 53 and realizing an oil-less system. However, the resin having the releasing performance does not typically have elasticity like a rubber material. Accordingly, if a thick release layer 33 is formed on the elastic layer 32, the flexibility of the surface of the fixing belt 53 might be lost to an extent, causing uneven glossiness. To obtain both flexibility and releasing performance, the release layer 33 has a thickness of from about 5 μm to about 50 μm, and preferably from about 10 μm to about 30 μm.

A primer layer may be provided between the layers, when needed. A durable layer may be provided on an inner surface of the substrate 31 to enhance durability against sliding of the heating roller 51 and the fixing roller 52.

Further, a heat generation layer may be preferably disposed on the substrate 31. For example, a layer made of copper (Cu) having a thickness of from about 3 μm to about 15 μm may be formed on a base layer made of, e.g., polyimide to be used as a heat generation layer.

The pressing roller 55 includes a cylindrical metal core 55*a*, a high heat-resistant elastic layer 55*b*, and a release layer 55*c*. The pressing roller 55 presses the fixing roller 52 via the fixing belt 53 to form the fixing nip N between the pressing roller 55 and the fixing roller 52. The pressing roller 55 has an outer diameter of from about 30 mm to about 40 mm. The elastic layer 55*b* has a thickness of from about 0.3 mm to about 5 mm and an Asker hardness of from about 20° to about 50°. The elastic layer 55*b* includes a heat-resistant material such as silicone rubber. Additionally, the release layer 55*c* including fluorine resin and having a thickness of from about 10 μm to about 100 μm is formed on the elastic layer 55*b* to increase the releasing performance upon two-sided printing operation.

The elastic layer 55*b* of the pressing roller 55 is harder than the elastic member 52*b* of the fixing roller 52. Hence, the pressing roller 55 is configured to press and be engaged with the fixing roller 52 via the fixing belt 53. Such an engagement gives a curvature to the sheet P enough to prevent the sheet P from being conveyed on the surface of the fixing belt 53 when the sheet P exits the fixing nip N. Thus, the releasing performance of the sheet P from the pressing roller 55 can be enhanced to prevent a paper jam.

Figure 4:
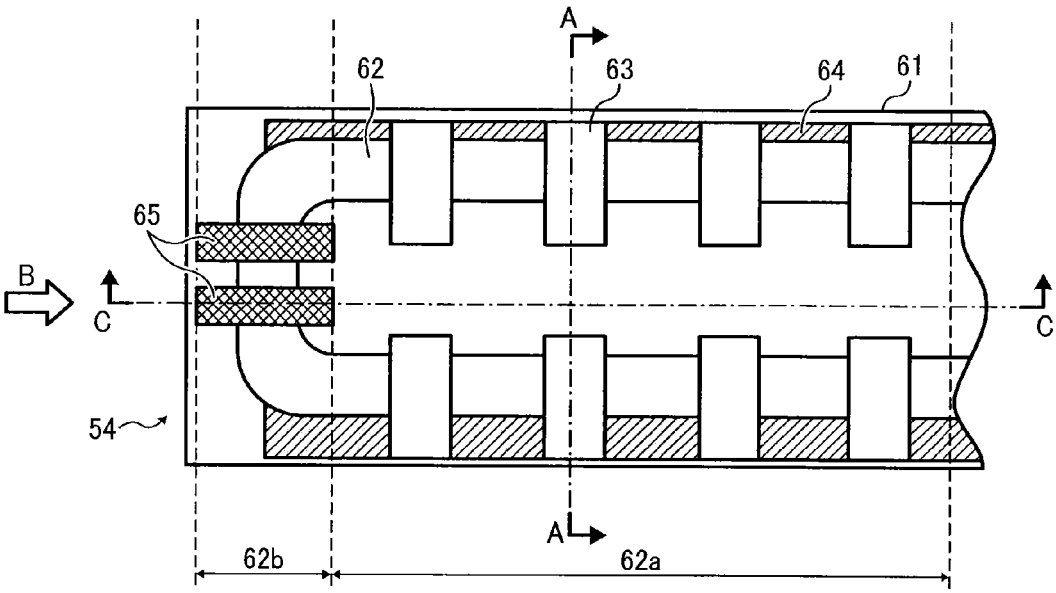
FIG. 4 is a plan view of an induction heater according to some embodiments of this disclosure.

Referring now to FIG. 4, a description is given of the induction heater 54 serving as a coil unit according to some embodiments of this disclosure.

FIG. 4 is a plan view of the induction heater 54 according to some embodiments of this disclosure.

The induction heater 54 includes an excitation coil 62, ferromagnetic cores such as arch cores 63, side cores 64 and end cores 65, and a case 61 to hold the excitation coil 62, the arch cores 63, the side cores 64, and the end cores 65. The arch cores 63, the side cores 64, and the end cores 65 encompass the excitation coil 62 to form a magnetic path to the heating roller 51. The windings of the excitation coil 62 have a straight part 62*a*, and a turning part 62*b* on each end of the excitation coil 62 in a longitudinal direction thereof.

The excitation coil 62 is prepared by winding a Litz wire from 5 times to 15 times. The Litz wire includes from about 50 to about 500 conductive wire strands, individually insulated and twisted together. Each conductive wire strand has a diameter of from about 0.05 mm to about 0.2 mm. A fusion layer is provided on a surface of the Litz wire. The fusion layer is stiffened by applying heat either by means of supplying power or in a thermostatic oven. Accordingly, a winding shape of the excitation coil 62 can be maintained. Alternatively, the excitation coil 62 may be prepared by winding a Litz wire without a fusion layer, and press-molding the wound Litz wire to reliably maintain a shape of the excitation coil 62. To provide the Litz wire with resistance against heat at a fixing temperature or higher, resin having insulation performance and heat resistance, such as polyamide-imide or polyimide, may be used as an insulation material to coat the Litz wire.

The windings of the excitation coil 62 are glued to the case 61 by, e.g., silicone glue. To obtain resistance against heat at a fixing temperature or higher, the case 61 includes high-resistant resin such as polyethylene terephthalate (PET) or liquid crystal polymers.

Each of the ferromagnetic cores, such as the arch cores 63, the side cores 64 and the end cores 65, includes a ferrite material such as a Mn—Zn (manganese-zinc) ferrite material or a Ni—Zn (nickel-zinc) ferrite material.

Figure 5C:
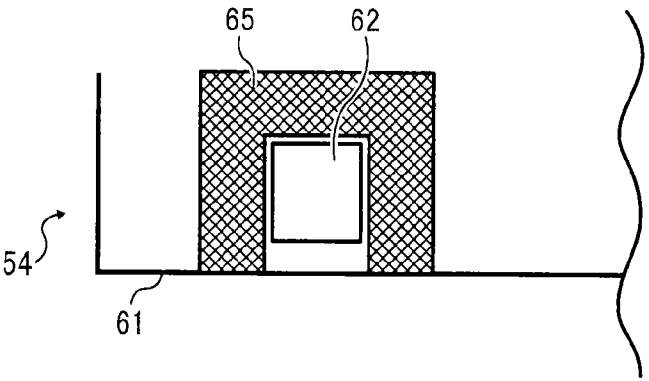
FIG. 5C is a cross-sectional view of the induction heater of FIG. 4 along a line C.
Figure 5B:
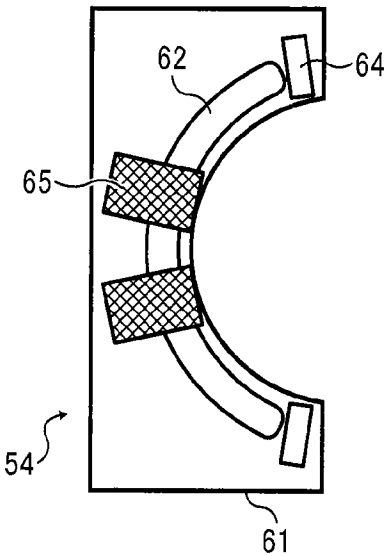
FIG. 5B is a cross-sectional view of the induction heater of FIG. 4, as seen in a direction indicated by an arrow B.
Figure 5A:
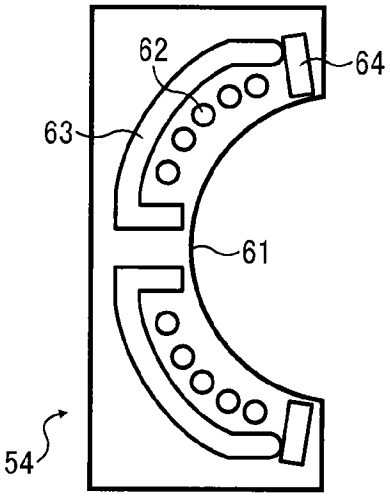
FIG. 5A is a cross-sectional view of the induction heater of FIG. 4 along a line A.

FIG. 5A is a cross-sectional view of the induction heater 54 of FIG. 4 along a line A. FIG. 5B is a cross-sectional view of the induction heater 54 of FIG. 4 as seen in a direction indicated by an arrow B. FIG. 5C is a cross-sectional view of the induction heater 54 of FIG. 4 along a line C.

As illustrated in FIGS. 5A and 5B, each of the cross sections of the excitation coil 62 and the case 61 has a shape that conforms to the circumferential surface of the heating roller 51.

As illustrated in FIG. 5A, the arch cores 63 are downsized so as to cover only one side of the windings of the excitation coil 62. Multiple arch cores 63, each having a substantially arch shape, are provided at an interval on the straight part 62*a* of the excitation coil 62. As illustrated in FIGS. 4 and 5B, multiple end cores 65 (e.g., two end cores 65), each being shaped like an arch to cover one side of the windings of the excitation coil 62, are disposed at each turning part 62*b* on the corresponding end of the excitation coil 62. As illustrated in FIG. 5C, each of the end cores 65 thus disposed at the turning parts 62*b* of the excitation coil 62 is shaped like an inverted U astride the excitation coil 62.

The end cores 65 are disposed at each end of the excitation coil 62 to increase a temperature at each end of the heating roller 51, thereby preventing a temperature decrease on an end of the sheet P in the fixing nip N, and further preventing fixing failures. The downsized multiple end cores 65 disposed at each end of the excitation coil 62 can effectively conduct magnetic flux arising from each end of the excitation coil 62 to efficiently increase the temperature at each end of the heating roller 51.

The arch cores 63 and the end cores 65 are bent toward the heating roller 51 in a central space surrounded by the excitation coil 62. Such a configuration allows the magnetic flux arising from the excitation coil 62 to be effectively conducted to the heating roller 51.

Figure 6A:
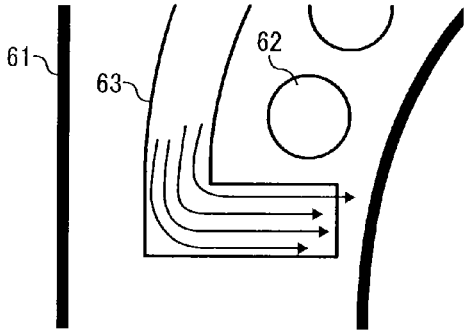
FIG. 6A is a partially enlarged view of the induction heater of FIG. 5A, schematically illustrating magnetic flux arising from an excitation coil wired with cores.
Figure 6B:
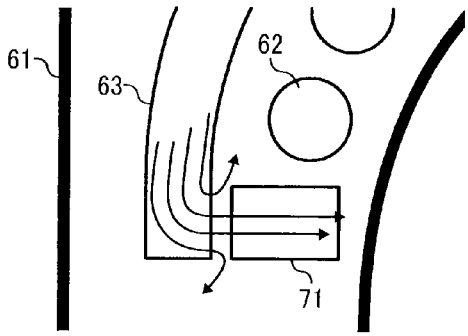
FIG. 6B is a schematic view of magnetic flux arising from an excitation coil wired with cores in a typical induction heater.

FIG. 6A is a partially enlarged view of the induction heater 54 of FIG. 5A, schematically illustrating the magnetic flux arising from the excitation coil 62 wired with the ferromagnetic cores. FIG. 6B is a schematic view of magnetic flux arising from an excitation coil 62 wired with ferromagnetic cores in a case 61 of a typical induction heater.

As illustrated in FIG. 6B, an I-shaped core 71 is disposed in a central space surrounded by the excitation coil 62 to increase heating efficiency. When an arch core includes multiple cores such as an arch core 63 and the I-shaped core 71, diamagnetic flux arises between the arch core 63 and the I-shaped core 71 that is unlikely to reach the core 71. By contrast, as illustrated in FIG. 6A, the arch core 63 is one continuous core. Accordingly, the magnetic flux arising from the excitation coil 62 can reach the heating roller 51 without generating diamagnetic flux. As a result, the efficiency of heat generation by the heating roller 51 is enhanced compared to the efficiency of heat generation by a typical heating roller, thereby reducing energy to operate the fixing device 40.

Referring back to FIG. 4, multiple side cores 64 are disposed in the longitudinal direction of the excitation coil 62 or an axial direction of the heating roller 51. If one longer side core is used instead of the multiple side cores 64, the longer side core might warp widely when a ferrite material included in the longer side core is sintered and contracts. Hence, the multiple side cores 64 are used instead of using one longer side core to prevent or reduce such warping of the side cores 64.

The fixing device 40 is not limited to the fixing device 40 incorporating a belt fixing method illustrated in FIG. 2. The fixing device 40 may include a fixing belt having a heat generation layer.

Figure 7:
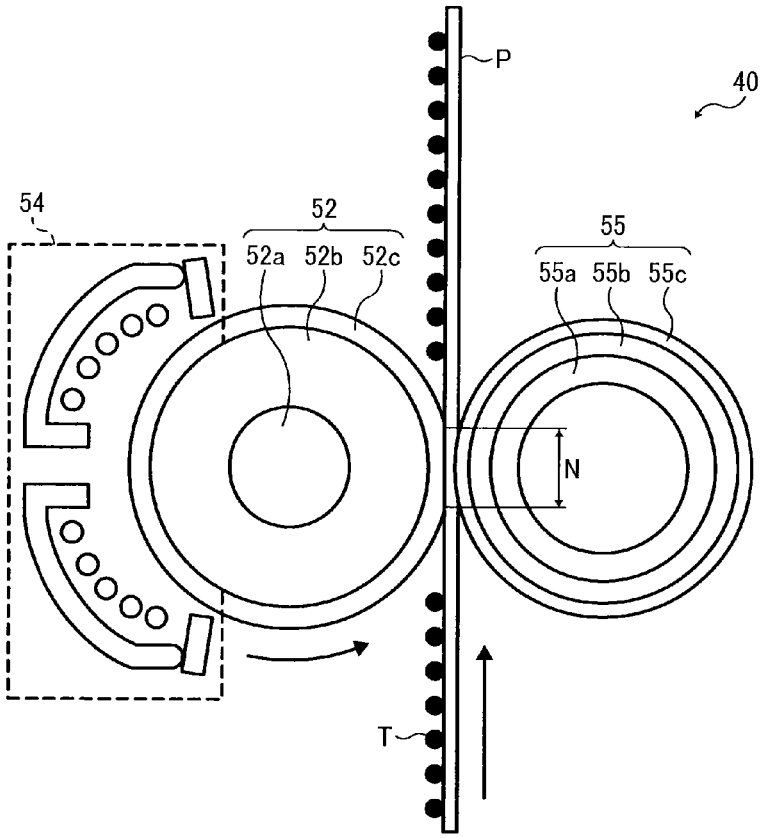
FIG. 7 is a cross-sectional view of a fixing device according to a second embodiment.

Referring now to FIG. 7, a description is given of a fixing device 40 according to a second embodiment.

FIG. 7 is a cross-sectional view of the fixing device 40 according to the second embodiment.

The fixing device 40 includes, e.g., an induction heater 54 serving as a magnetic flux generator, a fixing roller 52 serving as a rotator, and a pressing roller 55. The fixing roller 52 has a multilayer structure in which an elastic layer 52*b*, a heat generation layer 52*c* and the like are formed on a surface of a hollow metal core 52*a* made of, e.g., stainless steel or carbon steel. Specifically, the fixing roller 52 has an outer diameter of from about 30 mm to about 40 mm. The elastic layer 52*b* and the heat generation layer 52*c* are stacked on the metal core 52*a*.

The metal core 52*a* includes stainless steel such as SUS 304 (a type of stainless steel classified according to the Japanese Industrial Standards) and has a cylindrical shape with a thickness of about 1 mm or a solid cylindrical shape. The elastic member 52*b* includes, e.g., solid or foam heat-resistant silicone rubber to cover the meal core 52*a*. The elastic member 52*b* has a thickness of from about 3 mm to about 10 mm, and a JIS-A hardness of from about 10° to about 50°.

The heat generation layer 52*c* includes a base layer, a main heat generation layer, an elastic layer, and a release layer stacked in this order from an inner circumference side of the heat generation layer 52*c*. The base layer of the heat generation layer 52*c* includes nickel (Ni) and has a thickness of from about 3 μm to about 15 μm to increase the efficiency of heat generation. Alternatively, the base layer of the heat generation layer 52*c* may include stainless steel or a magnetic shunt alloy having a Curie point of from about 160° C. to about 220° C. In such a case, an aluminum member is disposed inside the magnetic shunt alloy to stop a temperature rise around the Curie point. Alternatively, the base layer may include polyimide. In such a case, the heat capacity of the heat generation layer is less than the heat capacity of the heat generation layer when a metal material is used in the base layer. Accordingly, a temperature rise can be achieved with lower energy.

The main heat generation layer of the heat generation layer 52*c* includes copper (Cu) and has a thickness not greater than 5 μm. A nickel (Ni) layer may be stacked on a surface of the copper (Cu) layer to prevent oxidation.

The elastic layer of the heat generation layer 52*c* includes silicone rubber and has a thickness of from about 100 μm to about 500 μm. The elastic layer of the heat generation layer 52*c* enhances adhesion of the fixing roller 52 with respect to the sheet P.

The release layer of the heat generation layer 52*c* includes a fluorine compound such as perfluoroalkoxy polymer resin (PFA) and has a thickness of from about 10 μm to about 100 μm. The release layer of the heat generation layer 52*c* enhances the releasing performance of toner from the surface of the fixing roller 52 which a toner image T directly contacts.

According to the second embodiment, the fixing roller 52 serves as a fixing member to fuse the toner image T and as a heat generating member that is directly heated by the induction heater 54.

It is to be noted that the heat generation layer 52*c* may alternatively have a single-layer base material made of magnetic metal. In such a case, the magnetic metal material of the heat generation layer 52*c* may include nickel (Ni) having a thickness of about 10 μm. Alternatively, iron, cobalt, copper or alloys thereof may be used.

A description is now given of a heating experiment to compare induction heaters 54 according a first example and a second example of this disclosure and an induction heater 54 according to a comparative example.

Figure 8B:
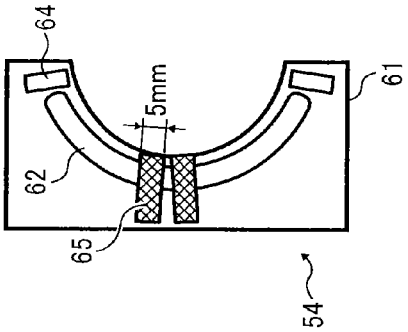
FIG. 8B is a cross-sectional view of an inside of the induction heater of FIG. 8A as seen in a direction indicated by an arrow B.
Figure 8A:
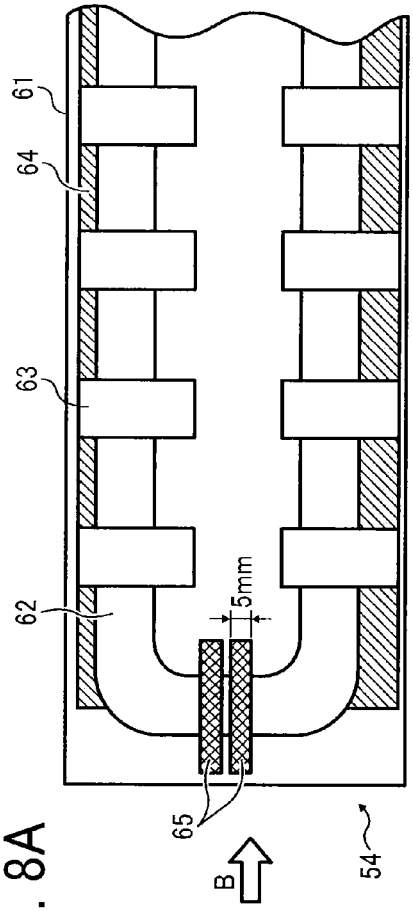
FIG. 8A is a schematic view of an induction heater according to a first example.

Referring now to FIGS. 8A and 8B, a description is given of the induction heaters 54 according the first example.

FIG. 8A is a schematic view of the induction heater 54 according to the first example. FIG. 8B is a cross-sectional view of an inside of the induction heater 54 of FIG. 8A as seen in a direction indicated by an arrow B.

A basic configuration of the induction heater 54 is the same as the basic configuration of the induction heater 54 of FIG. 4, except that two end cores 65, each having a width of about 5 mm, are disposed as close to each other as possible in the induction heater 54 according to the first example.

Figure 9B:
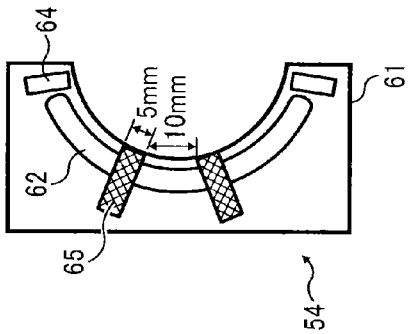
FIG. 9B is a cross-sectional view of an inside of the induction heater 54 of FIG. 9A as seen in a direction indicated by an arrow B.
Figure 9A:
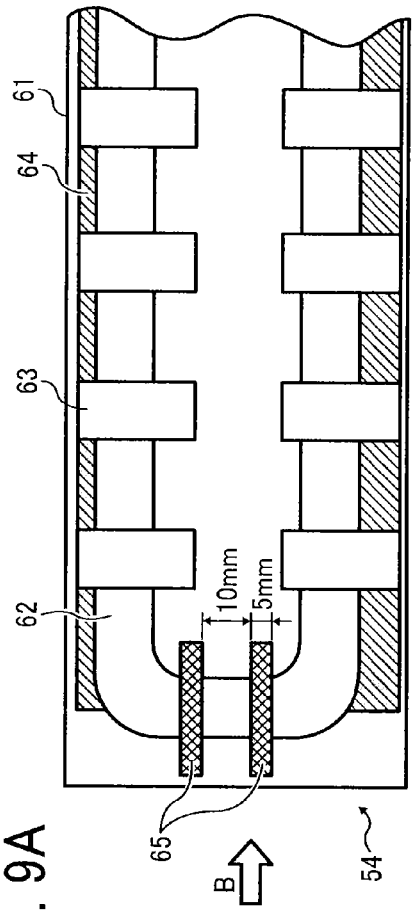
FIG. 9A is a schematic view of an induction heater according to a second example.

Referring now to FIGS. 9A and 9B, a description is given of the induction heater 54 according the second example.

FIG. 9A is a schematic view of the induction heater 54 according to the second example. FIG. 9B is a cross-sectional view of an inside of the induction heater 54 of FIG. 9A as seen in a direction indicated by an arrow B.

A basic configuration of the induction heater 54 is the same as the basic configuration of the induction heater 54 according to the first example, except that two end cores 65 are disposed at a relatively large interval in the induction heater 54 according to the second example. Specifically, the two end cores 65 are disposed with a distance of about 10 mm therebetween. Such an interval allows each of the end cores 65 facing the heating roller 51 to have an end substantially parallel to a tangential line of the circumferential surface of the heating roller 51. Although, according to the second example, the two end cores 65 are disposed with a distance of about 10 mm therebetween, the interval is preferably one to three times the width of the end cores 65. For example, because each of the end cores 65 has a width of about 5 mm, the interval is preferably from about 5 mm to about 15 mm.

Figure 10A:
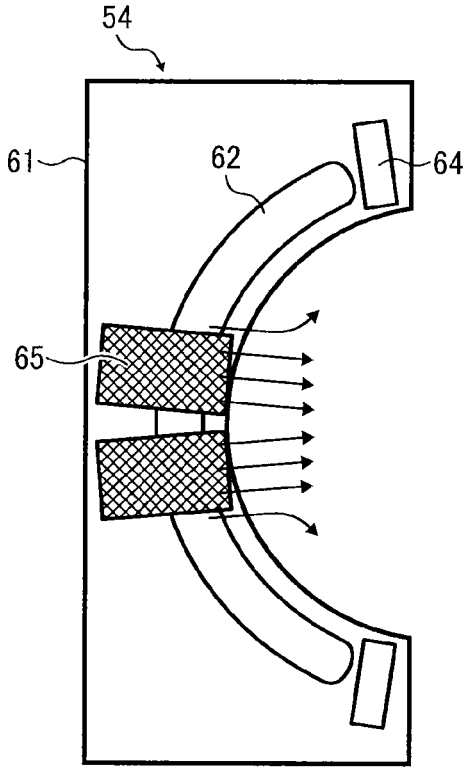
FIG. 10A is a cross-sectional view of the induction heater of FIG. 8A, illustrating an image of magnetic flux transmitted via ends of end cores.
Figure 10B:
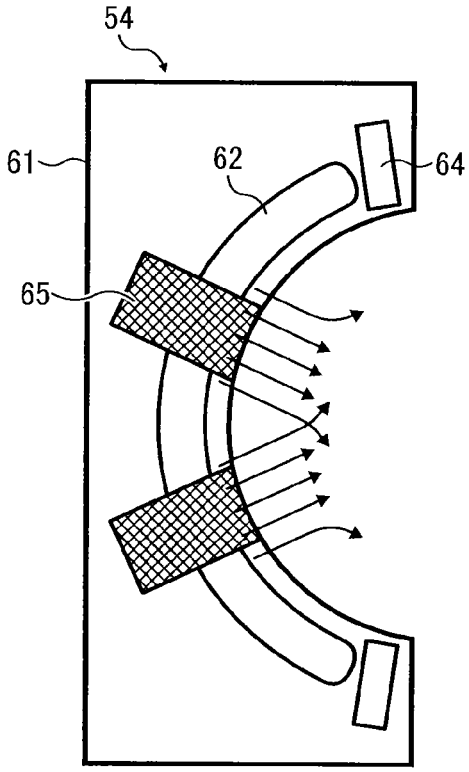
FIG. 10B is a cross-sectional view of the induction heater of FIG. 9A, illustrating an image of magnetic flux transmitted via ends of end cores.

Referring now to FIGS. 10A and 10B, a description is given of magnetic flux transmitted via ends of the end cores 65.

FIG. 10A is a cross-sectional view of the induction heater 54 according to the first example, illustrating an image of magnetic flux transmitted via ends of the end cores 65. FIG. 10B is a cross-sectional view of the induction heater 54 according to the second example, illustrating an image of magnetic flux transmitted via the ends of the end cores 65.

As illustrated in FIG. 10A, the end cores 65 are disposed as close to each other as possible. Hence, the end cores 65, particularly outer sides of the ends thereof, do not directly face the circumferential surface of the heating roller 51. Accordingly, as illustrated in FIG. 10A, the magnetic flux transmitted through the outer sides of the ends of the end cores 65 deviates from the heating roller 51. By contrast, as illustrated in FIG. 10B, the ends of the end cores 65 directly face the circumferential surface of the heating roller 51. Hence, a distance between each end of the end cores 65 and the heating roller 51 according to the second example is shorter than a distance between each end of the end cores 65 and the heating roller 51 according to the first example. Accordingly, the magnetic flux according to the second example reaches the heating roller 51 easier than the magnetic flux according to the first example. Thus, according to the second example, little magnetic flux deviates from the heating roller 51, thereby further enhancing the efficiency of heat generation. In other words, a larger interval between the end cores 65 has a greater influence on the magnetic flux arising from the excitation coil 62 to enhance the efficiency of heat generation.

Accordingly, the efficiency of heat generation at the ends of the heating roller 51 is enhanced to prevent a temperature decrease at the ends of the heating roller 51.

Figure 11B:
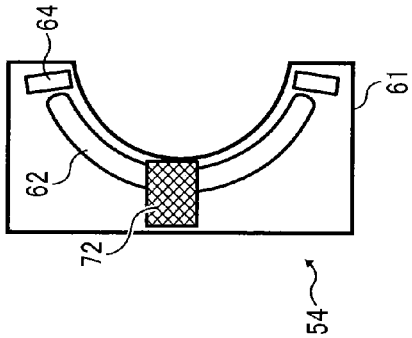
FIG. 11B is a cross-sectional view of the induction heater 54 of FIG. 11A as seen in a direction indicated by an arrow B.
Figure 11A:
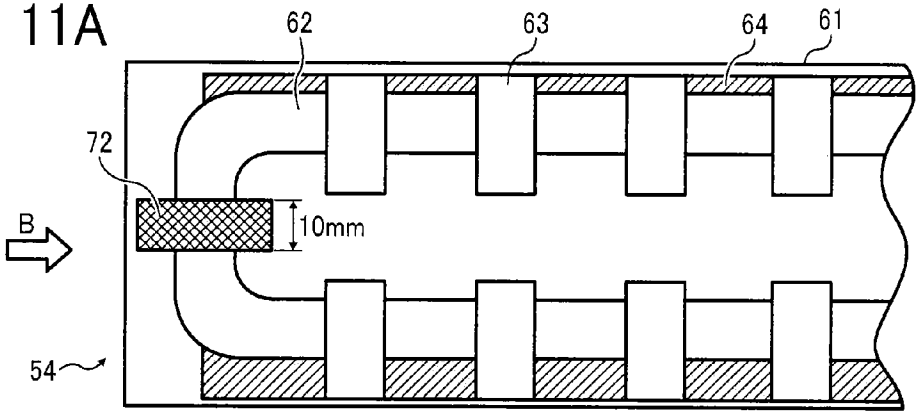
FIG. 11A is a schematic view of an induction heater according to a comparative example.

Referring now to FIGS. 11A and 11B, a description is given of the comparative example.

FIG. 11A is a schematic view of an induction heater 54 according to the comparative example. FIG. 11B is a cross-sectional view of an inside of the induction heater 54 as seen in a direction indicated by an arrow B.

A basic configuration of the induction heater 54 according to the comparative example is the same as the basic configurations of the induction heaters 54 according to the first example and the second example, except that one end core 72 having a width of about 10 mm is disposed in the induction heater 54 according to the comparative example. The end core 72 has a total volume equal to a total volume of each of the end cores 65 according to the first example and the second example. Hence, the induction heater 54 according to the comparative example has a preferred configuration to compare the effectiveness of disposition of the end core 72 with the effectiveness of disposition of the end cores 65 according to the first example and the second example.

Figure 12:
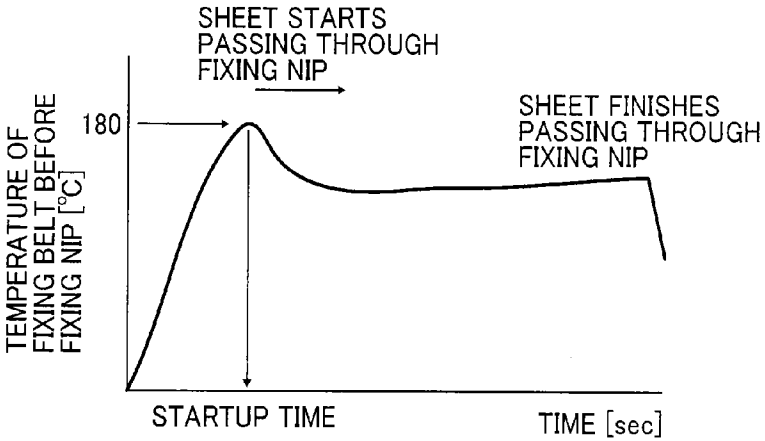
FIG. 12 is a graph of a result of measurement of temperature of the fixing belt before entering a fixing nip.
Figure 13:
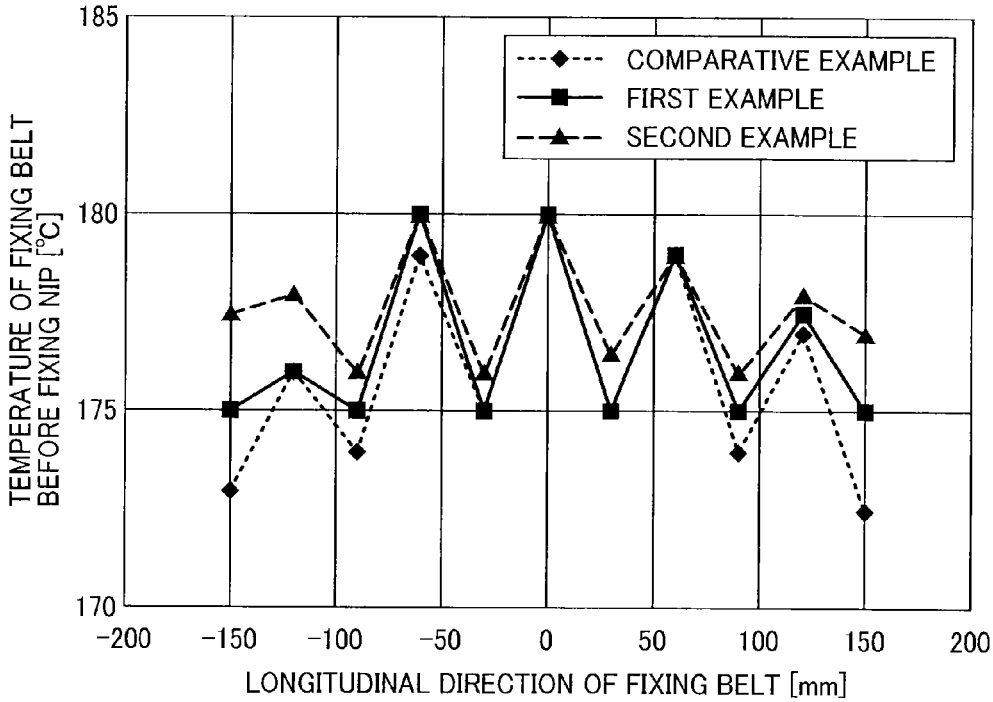
FIG. 13 is a graph of temperature distribution of the fixing belt before entering the fixing nip, right after a temperature sensor detects a temperature of 180° C.

Referring now to FIGS. 12 and 13, a description is given of the heating experiment conducted by individually installing the induction heaters 54 according to the first example, the second example and the comparative example in the fixing device 40 illustrated in FIG. 2. A temperature sensor was disposed before the fixing nip N of the fixing device 40 to measure a temperature of the fixing belt 53 before entering the fixing nip N.

Referring now to FIG. 12, a description is given of operation of the fixing device 40.

FIG. 12 is a graph showing a result of measurement of temperature of the fixing belt 53 before entering the fixing nip N.

Firstly, the temperature of the fixing belt 53 is increased to a target fixing temperature 180° C. (i.e., startup mode) to start conveyance of the sheet P through the fixing nip N. When the temperature of the fixing belt 53 reaches 180° C., conveyance of the sheet P is started through the fixing nip N. Although the temperature of the fixing belt 53 temporally decreases in the fixing nip N because the sheet P draws heat from the fixing belt 53, the temperature of the fixing belt 53 starts increasing again due to heat supplied by a heating unit. When the sheet P completes passing through the fixing nip N, the heating unit finishes supplying heat to the fixing belt 53 to decrease the temperature of the fixing belt 53.

In the heating experiment, the temperature sensor was disposed in the fixing device 40 at a position corresponding to a center of the fixing belt 53 in a longitudinal direction thereof to obtain temperature distribution of the fixing belt 53 in the longitudinal direction thereof before entering the fixing nip N, at a time right after the temperature sensor detected a temperature of 180° C. If a uniform temperature distribution is obtained in the longitudinal direction of the fixing belt 53, the conveyance of the sheet P can be started so that the sheet P passes through the fixing nip N. If a temperature at an end of the fixing belt 53 in the longitudinal direction thereof is lower than a temperature at a center of the fixing belt 53 in the longitudinal direction thereof, the conveyance of the sheet P cannot be started until the temperature at the end of the fixing belt 53 in the longitudinal direction thereof reaches 180° C. If the conveyance of the sheet P is started when the temperature at the end of the fixing belt 53 in the longitudinal direction thereof is lower than 180° C., fixing failures may be caused at the end of the fixing belt 53 in the longitudinal direction thereof.

FIG. 13 is a graph showing temperature distribution of the fixing belt 53 before entering the fixing nip N, at a time right after the temperature sensor detects a temperature of 180° C. The vertical axis indicates temperatures (° C.) of the fixing belt 53 before entering the fixing nip N. The horizontal axis indicates distances (mm) from the center (i.e., 0 mm) of the fixing belt 53 in the longitudinal direction thereof. As illustrated in FIG. 13, similar temperatures were obtained at the centers of the fixing belts 53 in the longitudinal directions thereof according to the first and second examples, and the comparative example. However, the temperature of the fixing belt 53 according to the comparative example was relatively low at both ends in the longitudinal direction thereof. Specifically, the temperature of the fixing belt 53 according to the first example was higher than the temperature of the fixing belt 53 according to the comparative example at the ends in the longitudinal directions thereof. The temperature of the fixing belt 53 according to second example was higher than the temperature of the fixing belt 53 according to the first example at the ends in the longitudinal directions thereof. Thus, according to the first and second examples, the temperatures at the ends of the fixing belts 53 in the longitudinal directions thereof were not relatively decreased compared to the comparative example. In other words, uniformity of the temperature distribution was enhanced. Accordingly, the efficiency of heat generation at the ends of the heating roller 51 is enhanced when multiple, relatively small end cores 65 are disposed at an interval, compared to the comparative example in which a single, relatively large end core 72 is disposed. Additionally, FIG. 13 shows that the induction heaters 54 according to the first and second examples have temperature distribution applicable to the fixing device 40.

As is clear from the result of the heating experiment, a fixing device (e.g., fixing device 40), employing an electromagnetic induction heating method, according to some embodiments enhances the efficiency of heat generation at ends of a heat generator (e.g., heating roller 51) in the longitudinal direction thereof. Accordingly, temperature uniformity of a fixing belt (e.g., fixing belt 53) is enhanced in the longitudinal direction thereof. According to some embodiments of this disclosure, an induction heater (e.g., induction heater 54) provides a reliable warm-up time to quickly start conveyance of a recording material (e.g., sheet P) through a fixing nip (e.g., fixing nip N) immediately when a temperature at a center of the fixing belt in the longitudinal direction thereof reaches a target fixing temperature. Accordingly, an image forming apparatus (e.g., image forming apparatus 100) incorporating the fixing device is more energy-efficient.

Figure 14:
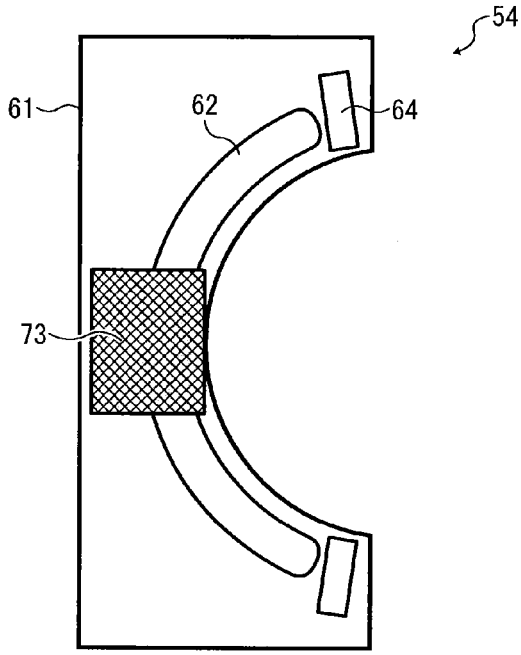
FIG. 14 is a cross-sectional view of an induction heater in which an end core is disposed.

Referring now to FIG. 14, a description is given of an induction heater 54 in which one end core 73 is provided.

FIG. 14 is a cross-sectional view of the induction heater 54.

To obtain an advantageous effect of the induction heater 54 according to some embodiments of this disclosure with one end core, the end core 73 has a relatively wide surface facing a circumferential surface of a heating roller 51, and a cylindrical contact surface to fitly contact the case 61.

The end core 73 includes a ferrite material formed by sintering compressed powder. The ferrite material contracts in a sintering process and the contraction amount of the ferrite material depends on parts thereof. Hence, a fine ferrite core, as the end core 73 illustrated in FIG. 14, may not be obtained. Further, such contraction may cause variation in core size. As a result, yields may decrease and production costs may increase.

According to some embodiments of this disclosure, multiple end cores (e.g., end cores 65), each being shaped like an inverted U, are disposed at each end of an excitation coil (e.g., excitation coil 62) to obtain the same advantageous effect of an induction heater (e.g., induction heater 54) in which one end core (e.g., end core 73) is disposed at each end of an excitation coil. Additionally, the multiple end cores are disposed at an interval at each end of the excitation coil to enhance the efficiency of heat generation at ends of a heat generator (e.g., heating roller 51). An enhanced efficiency of heat generation realizes a quick startup of an image forming apparatus (e.g., image forming apparatus 100) that is more energy-efficient.

It is to be noted that the number of constituent elements and their locations, shapes, and so forth are not limited to any of the structure for performing the methodology illustrated in the drawings.

For example, the fixing device may have more than two end cores. The number and positions of the side cores and arch cores may be preferably set to practice the embodiments.

The present disclosure has been described above with reference to specific embodiments. It is to be noted that the present disclosure is not limited to the details of the embodiments described above, but various modifications and enhancements are possible without departing from the scope of the invention. It is therefore to be understood that the present disclosure may be practiced otherwise than as specifically described herein. For example, elements and/or features of different illustrative embodiments may be combined with each other and/or substituted for each other within the scope of the present invention.

What is claimed is:

1. A fixing device comprising:

a rotator having a heat generation layer;

an excitation coil to inductively heat the heat generation layer;

ferromagnetic cores to direct magnetic flux arising from the excitation coil to the rotator; and a holder to hold the excitation coil and the ferromagnetic cores, wherein the ferromagnetic cores include multiple cores which are fully astride a corresponding section of each end of the excitation coil.

2. The fixing device according to claim 1, wherein the multiple cores are disposed at an interval at a turning part of each end of the excitation coil in a longitudinal direction of the excitation coil.

3. The fixing device according to claim 2, wherein the interval is one to three times a width of each of the multiple cores.

4. The fixing device according to claim 1, wherein the multiple cores are bent toward the rotator in a central space surrounded by the excitation coil.

5. The fixing device according to claim 4, wherein each of the multiple cores has an end substantially parallel to a tangential line of a circumferential surface of the rotator.

6. The fixing device according to claim 1, wherein:

the multiple cores are fully astride the corresponding section of each end of the excitation coil at a position of the excitation coil which is non-parallel to an axis of rotation of the rotator.

7. An image forming apparatus comprising the fixing device according to claim 1.

* * * * *